US010137914B2

(12) United States Patent
Williams

(10) Patent No.: US 10,137,914 B2
(45) Date of Patent: Nov. 27, 2018

(54) TRAIN SAFETY WARNING SYSTEM

(71) Applicant: Theodore Williams, Brooklyn Park, MN (US)

(72) Inventor: Theodore Williams, Brooklyn Park, MN (US)

( * ) Notice: Subject to any disclaimer, the term of this patent is extended or adjusted under 35 U.S.C. 154(b) by 286 days.

(21) Appl. No.: 15/153,926

(22) Filed: May 13, 2016

(65) Prior Publication Data

US 2017/0197644 A1 Jul. 13, 2017

Related U.S. Application Data

(60) Provisional application No. 62/387,827, filed on Jan. 7, 2016.

(51) Int. Cl.

| | |
|---|---|
| ***B61L 23/00*** | (2006.01) |
| ***B61L 7/06*** | (2006.01) |
| ***B61L 9/00*** | (2006.01) |
| ***B61L 13/00*** | (2006.01) |

(52) U.S. Cl.

CPC ..... *B61L 23/007* (2013.01); *B61L 7/06* (2013.01); *B61L 9/00* (2013.01); *B61L 13/002* (2013.01); *B61L 2207/00* (2013.01)

(58) Field of Classification Search

CPC ..... B61L 23/00; B61L 23/007; B61L 7/06; B61L 9/00; B61L 13/00; B61L 13/002

See application file for complete search history.

(56) References Cited

U.S. PATENT DOCUMENTS

| | | | | |
|---|---|---|---|---|
| 2001/0050709 | A1* | 12/2001 | Samejima | B61C 17/00 348/143 |
| 2010/0163687 | A1* | 7/2010 | Brand | B61L 3/127 246/117 |
| 2012/0318932 | A1* | 12/2012 | Parida | B61L 23/00 246/473 R |
| 2015/0302752 | A1* | 10/2015 | Holihan | G08G 1/164 246/62 |
| 2015/0307119 | A1* | 10/2015 | Ghaly | B61L 27/0038 246/122 R |
| 2017/0197644 | A1* | 7/2017 | Williams | B61L 23/007 |

* cited by examiner

*Primary Examiner* — Jason C Smith

(74) *Attorney, Agent, or Firm* — Fredrikson & Byron, P.A.

(57) ABSTRACT

A system for providing train safety warnings can include a train vehicle positioned on and movable along a track, as well as a warning device. The warning device can be associated with a receiving device that is in signal communication with a transmitter, such as a transmitter included on the train vehicle. An emitter of the warning device is configured to output an indication that the train vehicle is approaching based on the signal communication with the transmitter. In some instances, the warning device, and/or the emitter thereof, can be positioned at a same elevation as the track.

20 Claims, 3 Drawing Sheets

TRAIN SAFETY WARNING SYSTEM

CROSS-REFERENCE TO RELATED APPLICATION

This application claims the benefit of provisional application No. 62/387,827, filed Jan. 7, 2016.

TECHNICAL FIELD

This disclosure relates generally to train safety warning systems, devices, and methods, such as for providing one or more indications that a train vehicle is approaching.

BACKGROUND

Train vehicles are used in various environments for various purposes. In one example, train vehicles are used to transport passengers from one location to another. Often, this will involve the train vehicle passing through an urban environment, as is the case, for instance, with metropolitan light rail transit systems.

Many metropolitan light rail transit systems operate on tracks positioned at a common elevation with various other urban travel pathways, including roads, bike paths, and pedestrian walkways. As a result, a single stretch of track can frequently intersect on-grade with some or all of these types of urban travel pathways. Moreover, in many cases this same stretch of track may actually share a road (e.g., the stretch track is between two opposite lanes of traffic on a roadway), or other travel pathway, without any sort of physical barrier therebetween. Consequently, this layout invariably causes collisions between the train vehicle and the automobile, bike, and/or pedestrian using the travel pathway.

To further complicate matters, distractions to automobile drivers, bike riders, and pedestrians are more prevalent than ever. For instance, distractions posed by cellular telephone, or other mobile device, usage are ever-increasing. Furthermore, urban environments are proliferated with advertising, or other content, precisely intended to catch the eye of automobile drivers, bike riders, and pedestrians (e.g., through use of bright colors, intense illuminations, etc.). In addition to these and other distractions, some automobile drivers, bike riders, and pedestrians have impairments that prevent them from sensing one or more particular types of safety warnings.

However, despite the risks inherent to the described layout of train vehicle transit system tracks, this type of track layout is in wide-spread use, and its usage will likely continue to grow as urban populations across the world increase. This is due, in large part, to the relatively low cost of constructing this type of track layout and the accompanying train vehicle transit system. For one, by positioning tracks at a same elevation as various other urban travel pathways, extra ground-level space required for the tracks, as well as the use of tunnels and/or elevated tracks (e.g., bridges), is minimized. As such, without appropriate safety precautions, collisions between train vehicles and the automobiles, bikes, and/or pedestrians using the travel pathways will continue to be a problem.

SUMMARY

In general, this disclosure is directed to a system for providing train safety warnings. The system may include a train vehicle positioned on and movable along a track, as well as a warning device. The warning device can be associated with a receiving device that is in signal communication with a transmitter included on the train vehicle. An emitter of the warning device is configured to output an indication that the train vehicle is approaching based on the signal communication with the transmitter of the train vehicle.

The warning device may be positioned at a same elevation as the track, for instance in one example having the emitter positioned at the same elevation as the track. In addition to the elevation of the warning device, the warning device can be positioned adjacent the track, or in other examples can be positioned at the track (e.g., at a space defined between first and second opposing rails of the track). The indication output by the emitter of the warning device, for instance, can be in the form of any one or more of numerous visible light and/or audible indications. Various embodiments of the system can use any number of warning devices, and in some cases multiple warning devices may be grouped and addressed on a group-by-group basis so as to output a common indication (e.g., a common indication pattern, a common adjustment to the indication, etc.).

In one example, the transmitter, included on the train vehicle, and the receiving device, associated with the warning device, are in direct signal communication. In another example, the transmitter and receiving device are in indirect signal communication, such as through a central control station. The signal communication between the transmitter and receiving device can include any type of information related to various parameters of the train vehicle. Such information may include information related to a position of the train vehicle and/or a rate of motion of the train vehicle. In one example, the receiving device can process the received information related to various parameters of the train vehicle so that the indication is output by the warning device (e.g., via the emitter) based on the processing. But, in another example the information can be processed external to the receiving device (e.g., at the train vehicle, at the central control station, etc.) so that the communication received at the receiving device may be a signal to output the indication at the warning device based on the information related to various parameters of the train vehicle processed externally of the receiving device.

In use, the system can allow the emitter of the warning device to output the indication that the train vehicle is approaching at a time that is a function of the position of the train vehicle and/or the rate of motion of the train vehicle. In this manner, certain embodiments of the system act to take dynamic train parameters (e.g., varying rates of motion at varying positions along the track) and output an indication that a train vehicle is approaching in a way that provides a generally constant period of warning prior to the train vehicle arriving. This can be true even where each approaching train vehicle has its own unique parameters (e.g., varying rates of motion at varying positions along the track, differing numbers of stops along the track preceding the location of the warning device, such as due to timing of traffic signals at intersections, etc.) as it approaches the warning device. Thus, the indication output from the warning device (e.g., from the emitter of the warning device) can be output for a period of time that is of a constant duration for a range of different positions along the track and rates of motion of oncoming train vehicles. This constant period of time can be measured from a first time at which the indication for a particular oncoming train is output to a time at which the train vehicle encounters the warning device (e.g., the emitter). As such, the indication can provide a same warning period prior to the train vehicle arriving at the location of the warning device in relation to train vehicles having their own unique parameters. In many cases, the indication will be terminated as the train vehicle passes over the warning device (e.g., over the emitter).

In one example, a warning device for providing a train safety warning is described. The warning device has a receiving device configured to be in signal communication with a train vehicle that is movable along a track. The warning device also has an emitter configured to output an indication that the train vehicle is approaching based on the signal communication between the receiving device and the train vehicle. The emitter can be positioned at a same elevation as the track. The indication output by the emitter can be visible light and/or audible noise.

In examples where the emitter outputs visible light as one type of the indication, the warning device (and thus the emitter) can be positioned and configured to output the visible light indication in a manner that catches the viewing angle of a pedestrian looking downward (e.g., looking in a ground-level direction at a mobile device) simultaneous to walking. Consequently, the warning device may be better equipped than traditional crossing guard lights to prevent collisions with the train vehicle in the case of distracted pedestrians looking downward and who would not otherwise notice a traditionally positioned and configured crossing guard light. In one instance, the emitter is positioned at a same elevation as the track and is configured to output visible light from a first side at an angle less than ninety degrees. Such a positioned emitter may further be configured to output visible light from a second side, opposite the first side, at an angle less than ninety degrees.

In another example, a method for train safety warning is described. The method includes sending a signal from a train vehicle positioned on and movable along a track to a receiving device associated with a warning device having an emitter positioned at a same elevation as the track. The method also includes outputting an indication from the emitter that the train vehicle is approaching based on the signal from the train vehicle. The indication is output from the emitter at a first time that is a function of both a position along the track and a rate of motion of the train vehicle. In one embodiment of the method, the indication can be terminated as the train vehicle encounters the location at which the warning device is positioned.

The details of one or more examples are set forth in the accompanying drawings and the description below. Other features, objects, and advantages will be apparent from the description and drawings, and from the claims.

BRIEF DESCRIPTION OF DRAWINGS

The following drawings are illustrative of particular examples of the present invention and therefore do not limit the scope of the invention. The drawings are not to scale (unless so stated) and are intended for use in conjunction with the explanations in the following detailed description. Examples of the present invention will hereinafter be described in conjunction with the appended drawings.

DETAILED DESCRIPTION

The following detailed description is exemplary in nature and is not intended to limit the scope, applicability, or configuration of the invention in any way. Rather, the following description provides some practical illustrations for implementing examples of the present invention. Those skilled in the art will recognize that many of the noted examples have a variety of suitable alternatives.

This disclosure is generally directed to systems, devices, and methods for providing train safety warnings. Embodiments thereof can provide a warning that a train vehicle is approaching in a manner that may reduce the number of collisions between train vehicles and automobiles, bikes, and/or pedestrians using travel pathways adjacent to and/or intersecting the train vehicle track. For instance, various embodiments can be positioned and used at locations that otherwise are impractical for traditional crossing gates yet effectively convey the location of potential danger. Certain embodiments are configured to convey an indication of an approaching train vehicle to those who may be looking at a downward angle simultaneous to their forward motion (e.g., using a mobile device while walking). Some embodiments can use information related to train vehicle parameters (e.g., dynamic parameters, such as varying rates of motion at varying positions along the track) to provide an indication that a train vehicle is approaching in a way that provides a generally constant period of warning prior to the train vehicle arriving.

Figure 1:
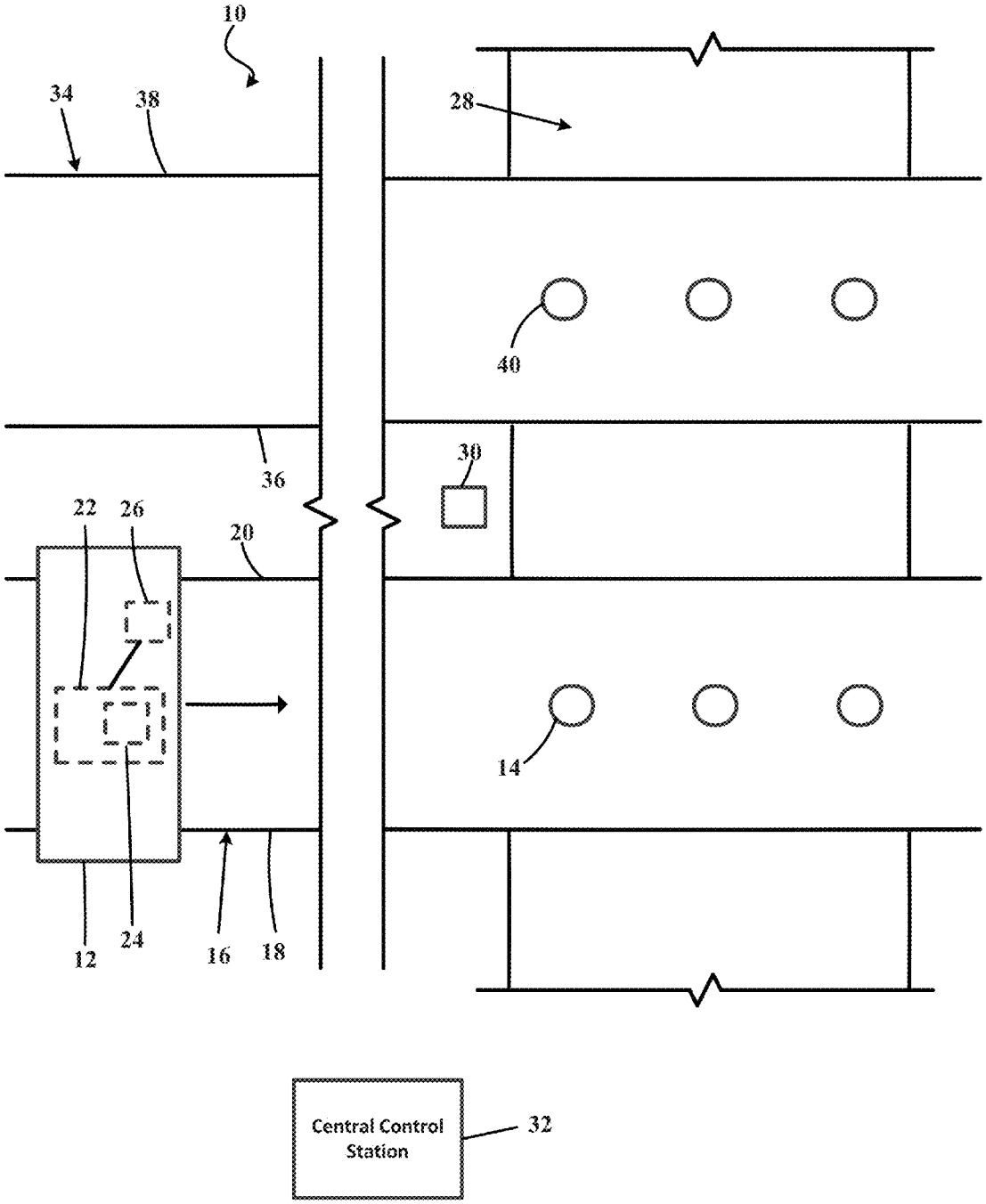
FIG. 1 is a schematic plan view diagram illustrating an exemplary embodiment of a train safety warning system.

FIG. 1 shows a schematic plan view diagram illustrating an exemplary embodiment of a train safety warning system 10. The illustrated system 10 includes a train vehicle 12 and one or more warning devices 14.

The train vehicle 12 is positioned on and movable along a track 16. The track 16 includes, in the example shown, first and second opposing rails 18, 20. The opposing rails 18, 20 define a space therebetween. Although the track 16 is shown and described in the form of two opposing rails, embodiments of the described system are equally applicable to other track configurations used to provide a means along which a train vehicle is conveyed.

The train vehicle 12 can include a control panel 22 inside the train vehicle 12. The control panel 22 may be used by a train operator to monitor and/or control various functions and parameters related to the train vehicle 12. In the example shown, the control panel 22 can include a first input device 24, although in other examples the first input device 24 can be in other locations within the train vehicle 12. The control panel 22, including the input device 24, is shown in communication with a transmitter 26 of the train vehicle 12. The transmitter 26 can be used to send (e.g., wirelessly) data, control signals, or other information from the train vehicle 12 to one or more desired external locations. In some examples, the transmitter 26 can also serve to receive (e.g., wirelessly) data, control signals, or other information from one or more particular external locations. In such examples, the transmitter 26 may thus be, at least in part, a transceiver providing two-way communication capability between the train vehicle 12 and one or more external locations.

As noted, the system 10 includes one or more warning devices 14. The one or more warning devices 14 can provide (e.g., via an emitter) an indication that the train vehicle 12 is approaching. The one or more warning devices 14 can be positioned at a variety of spatial locations. In the example shown in FIG. 1, the warning devices 14 are positioned on the track 16 at the space defined between the first and second opposing rails 18, 20. In this way, one or more warning devices 14 are bounded by the rails 18, 20. In another example, the warning devices 14 can be positioned adjacent the track 16, such as next to a rail 18 or 20 on a side of the rail 18 or 20 opposite the space defined between the rails 18, 20. In one further such example, the warning devices 14 can be positioned adjacent the track 16, such as next to both rails 18 and 20 so as to be on both a side of the rail 18 opposite the space defined between the rails 18, 20 and a side of the rail 20 opposite the space defined between the rails 18, 20. In yet another example, one or more warning devices 14 can be positioned on the track 16 and one or more warning devices 14 can be positioned adjacent the track 16.

In addition to the variety of spatial locations, the one or more warning devices 14 can be positioned at a variety of elevations at any of the above described spatial locations. In the example shown in FIG. 1, the warning devices 14 are positioned at a same elevation as the track 16 (e.g., ground level) such that the warning devices 14 are on-grade with the track 16. This could include, in some examples, the one or more warning devices 14 being embedded in the space between the rails 18, 20 and/or the area adjacent the track 16 so as to be substantially flush with the surface of this space. Where the warning device 14 is positioned at the same elevation as the track 16, an emitter (shown, e.g., in FIGS. 2A and 2B) of the warning device 14 can be positioned at the same elevation as the track 16 (e.g., the emitter being embedded in the space between the rails 18, 20 and/or the area adjacent the track 16 so as to be substantially flush with the surface of this space.). In certain examples, some warning devices 14 can be positioned at a same elevation as the track 16, while at the same time other warning devices 14 can be positioned at an elevation above that of the track 16.

As shown in FIG. 1, a travel pathway 28 (e.g., a road, bike path, and/or pedestrian walkway) can intersect the track 16. The travel pathway 28 as shown runs at a same elevation as the track 16. Thus, the travel pathway 28 intersects the track 16 at the common elevation such that any automobile, bicycle, or pedestrian moving along the travel pathway 28 will cross along the surface of the track 16. In certain environments through which a stretch of the track 16 passes, there may be a high frequency of such common elevation intersections with travel pathways 28. One example includes stretches of track utilized in a metropolitan transit system, where common elevation intersections with travel pathways can occur at least every block. Consequently, given not only the high frequency of common elevation intersections with travel pathways, but also high volume usage of these same travel pathways, it may be impractical to utilize crossing gates at each such intersection of the track 16 and a travel pathway.

By positioning the warning device 14 at the same elevation as the track 16 (e.g., embedding the warning device 14 within the space between the rails 18, 20 and/or the area adjacent the track 16) passage along the travel pathway 28 at the intersection with the track 16 may be unobstructed at all times. As seen in the example of FIG. 1, warning devices 14 are positioned at a location along the track 16 where the track 16 intersects the travel pathway 28. As a result, the one or more warning devices 14 can provide the indication that the train vehicle 12 is approaching at the location where a collision is most likely to occur—the common elevation intersection of the track 16 and the travel pathway 28.

The indication that the train vehicle 12 is approaching output by the warning device 14 (e.g., output by an emitter of the warning device 14) can take any of a variety of forms. In one example, the indication output by the warning device 14 is visible light of a first color (e.g., red, yellow, green, etc.). In another example, the indication output by the warning device 14 is an audible indication (e.g., a horn, whistle, buzzer, etc.). In some examples, the indication output by the warning device 14 is a combination of visible light and an audible sound, whether simultaneous of alternating. Any one or more of the indications can be output in a constant manner, or can be adjusted over time.

In one embodiment of the system 10, the warning device 14 (and thus the emitter thereof) is configured to adjust the indication that the train vehicle 12 is approaching. Such adjustment could be made on the basis of parameters related to the train vehicle 12, including changes in position and/or a rate of motion of the train vehicle 12 along the track 16. For instance, the indication output by the warning device 14 at a first time can be visible light of a first color (e.g., constant emission of the first color, flashing of the first color) and may be adjusted to visible light a second color at a second time when the train vehicle 12 is closer to approaching the warning device 14. In addition to, or as an alternative to, adjusting the color of the visible light, the warning device 14 can adjust a pattern of the visible light on the basis of parameters related to the train vehicle 12, such as increasing a frequency at which the visible light is flashed as a position of the train vehicle 12 along the track 16 gets closer to the warning device 14.

Multiple warning devices 14, such as shown in FIG. 1, can be grouped and operate in synchronization, such that each warning device 14 outputs, and in some cases adjusts, the indication the same as the other warning devices 14 in the particular group. Groups of warning devices 14 can, in some cases, be located at respective same sections of the track 16 (e.g., at or near sections where the track 16 intersects the travel pathway 28 at a common elevation). As one example, each warning device 14 in a group can be associated with a same receiving device. This can then allow a group of warning devices 14 to output the indication based on the same parameters related to the train vehicle 12 received at the receiving device, as will be described further below.

The one or more warning devices 14 can provide (and in some cases adjust and/or terminate) the indication that the train vehicle 12 is approaching based on one or more communications from the train vehicle 12. This can allow, for example, a time at which the indication is output, a duration of the indication, and/or an adjustment to the indication to be a function of one or more parameters related to the train vehicle 12. For example, the time at which the indication is output, the duration of the indication, and/or any adjustments to the indication can be a function of a position of the train vehicle 12 along the track 16 and/or a rate of motion of the train vehicle 12. In this example, the indication may be provided by the one or more warning devices 14 in a manner that accounts for the dynamic nature of the train vehicle's movement (e.g., variations in rate) along the track 16, which may be particularly dynamic in an urban environment. This in turn can allow the indication that the train vehicle 12 is approaching to represent a generally constant period of warning prior to the train vehicle 12 arriving, for instance, at the location of the warning device 14. In one further such example, the indication can be first output from the warning device 14 (e.g., via the emitter thereof) at a time that is a function of the present position of the train vehicle 12 along the track 16 and the present rate of motion of the train vehicle 12, and second subsequently adjusted at a later time that is a function of the present position of the train vehicle 12 along the track 16 and the present rate of motion of the train vehicle 12. Communications from the train vehicle 12 can be made, received, and used in a variety of ways, and non-limiting examples of this will now be described.

In the example shown in FIG. 1, the one or more warning devices 14 are associated with a receiving device 30. The receiving device 30 can be positioned at a variety of locations, and as shown here is located adjacent the track 16. In the illustrated example, each of the warning devices 14 is in communication with the same receiving device 30, such as wirelessly or through a connected, hardwired communication line. In another example, the receiving device 30 can be included as part of the warning device 14, such that each warning device 14 may have its own individual receiving device 30. The receiving device 30 can be configured to receive data, control signals, and/or other information from the train vehicle 12 and/or one or more other external locations through a communications link therewith. In some cases, the receiving device 30 may also be configured to send data, control signals, or other information to the train vehicle 12 and/or one or more other external locations through a communications link therewith. In such cases, the receiving device 30 could include, at least in part, a transceiver to facilitate two-way communication between the warning devices 14 and the train vehicle 12 and/or other external locations.

As one example, the receiving device 30 is in communication (e.g., signal communication) with the train vehicle 12. In one embodiment of the system 10, the transmitter 26 of the train vehicle 12 can be in direct communication with the receiving device 30. This embodiment can take several forms. In one form, the transmitter 26 sends to the receiving device 30 any information related to the train vehicle 12, including various parameters related to the train vehicle 12. For instance, the transmitter 26 can send information (e.g., in substantially real-time) related to a position of the train vehicle 12 along the track 16 and/or a present rate of motion of the train vehicle 12 to the receiving device 30.

In one instance of this example, the receiving device 30 can include a local processor and computer readable instructions stored in a local memory and executed by the local processor for processing the received information from the transmitter 26. The receiving device 30 can locally process according to the stored instructions, for instance, the position of the train vehicle 12 along the track 16 and the present rate of motion of the train vehicle 12 to determine 1) when to output the indication, 2) the duration for which the indication is to be output, and/or 3) whether any adjustments to the indication are to be made. In one case, the receiving device 30 is configured to use the position of the train vehicle 12 along the track 16 and the present rate of motion of the train vehicle 12 to output the indication at a time and for a duration that provides a generally constant period of warning prior to the train vehicle 12 arriving at the location of the warning device 14. Thus, the indication can be output to provide the generally constant period of warning prior to the train vehicle 12 arriving for a range of different positions of the train vehicle 12 along the track 16 and a range of different rates of motion of the train vehicle 12.

In some embodiments the communication between the transmitter 26 and the receiving device 30 can be continuous, such as continuous once the train vehicle 12 is within a predetermined distance of the receiving device 30 and/or warning device 14. In other embodiments, the communication between the transmitter 26 and the receiving device 30 can occur at predetermined intervals (e.g., every one, three, five, ten, etc. seconds), such as at predetermined intervals once the train vehicle is within a predetermined distance of the receiving device 30 and/or warning device 14. In certain embodiments, the communication between the transmitter 26 and the receiving device 30 can occur at the command of a user of the train vehicle 12 regardless of the position of the train vehicle 12.

In other additional, or alternative, embodiments of the system 10, the transmitter 26 of the train vehicle 12 can be in communication with the receiving device 30 through a central control station 32. The transmitter 26 can send similar information as that described previously to the central control station 32. The central control station 32 may then send a communication to the receiving device 30 with the same information, and the receiving device 30 can process this information as previously described. Therefore, in this type of example the central control station 32 acts as relay for the information. Alternatively, the central control station 32 can process the information received from the train vehicle 12 as previously described, instead of the processing occurring locally at the receiving device 30. This may lead to lower costs associated with the receiving device 30 and/or warning devices 14. In this case, the receiving device 30 could receive a signal communication from the central control station 32 that causes the warning device 14 to output the indication that the train vehicle 12 is approaching to provide the generally constant period of warning prior to the train vehicle 12 arriving for a range of different positions of the train vehicle 12 along the track 16 and a range of different rates of motion of the train vehicle 12.

In some instances, the central control station 32 may process additional information unrelated to the train vehicle 12. For instance, the control station 32 can use a data input in the described processing for data related to traffic signals (e.g., timing of signal switching, current status of a signal, preprogrammed patterns of the signal) positioned at various intersections of the track 16 and travel pathways 28. Thus, the central control station 32 may process not only the position of the train vehicle 12 along the track 16 and the present rate of motion of the train vehicle 12, but also traffic signal data to, in some cases, increase the accuracy of the indication output by the warning device 14 by accounting for future variations in rate of the train vehicle 12 prior to arriving at the location of the warning device 14 and/or the receiving device 30.

This can also be achieved in the example described above where the receiving device 30 processes the information locally, by configuring the receiving device 30 to include an input from any of a variety of traffic signals. In one case, the receiving device 30 can be configured to receive input from one or more traffic signals positioned at common elevation intersections of the track 16 and the travel pathways uptrack (e.g., at a location along the track 16 that will be encountered by the train vehicle 12 prior to the location of the warning devices 14) of the receiving device 30. In this way, the receiving device 30 can use information related to both the train vehicle 12 (e.g., the position of the train vehicle 12 along the track 16 and the present rate of motion of the train vehicle 12) and one or more uptrack traffic signals to determine when to output the indication, the duration for which the indication is to be output, and/or whether any adjustments to the indication are to be made.

In another example, instead of the described processing occurring at the receiving device 30 or the central control station 32, the same parameters related to the train vehicle 12 can be processed locally at train vehicle 12, such as at the control panel 22. For instance, the position of the train vehicle 12 along the track 16 and the present rate of motion of the train vehicle 12 may be processed at the train vehicle 12. Here, the processed information may further include as an input a downtrack location of the receiving device 30 and/or warning device 14 (e.g., where such location is preprogrammed into the train vehicle 12 and/or is communicated to the train vehicle 12 from the receiving device 30 such as when the train vehicle 12 is within a predetermined distance of the receiving device 30). Once this processed information indicates that the train vehicle 12 will encounter the receiving device 30 and/or warning device 14 within a predetermined time period, the transmitter 26 can then send to the receiving device 30 a signal communication. This signal communication can cause the warning device 14 (and thus emitter thereof) to output the indication that the train vehicle 12 is approaching. Therefore, the processing at the train vehicle 12 can also act to cause the indication to be output at the warning device 14 to provide the generally constant period of warning prior to the train vehicle 12 arriving for a range of different positions of the train vehicle 12 along the track 16 and a range of different rates of motion of the train vehicle 12.

In addition to the transmitter 26 sending various parameters related to the train vehicle 12 and/or other communications to the receiving device 30, the transmitter 26 can send a control signal to the receiving device 30. For example, a user can manually actuate the first input device 24 at the train vehicle 12, which causes the transmitter 26 to send the control signal to the receiving device 30. Upon receiving the control signal, the receiving device 30 can convey a communication to the emitter of the warning device 14 to output the indication that the train vehicle 12 is approaching. In some cases, the control signal can additionally, or alternatively, serve to cause the indication output at the warning device 14 to be adjusted (e.g., to an indication state signaling that the train vehicle is closer to the warning device 14 than the previously emitted indication state). This type of adjustment can be determined by using, at least in part, the position of the train vehicle 12 along the track 16 and the present rate of motion of the train vehicle 12 in combination with the receipt of the control signal from the train vehicle 12. Therefore, the first input device 24 at the train vehicle 12 can serve as a type of emergency activator of the indication at the warning device 24 when deemed appropriate by the train vehicle user.

The description provided herein can be equally applied where the system 10 is employed in an environment that includes a second track 34. The second track 34 is similar to the track 16 already described. A separate train vehicle may be positioned on and movable along the second track 34, such as in an opposite direction as that shown for the train vehicle 12. The second track 34 includes, in the example shown, first and second opposing rails 36, 38. The opposing rails 36, 38 define a space therebetween. One or more warning devices 40 can be included on, or adjacent to, the track 34. In the example shown, the warning devices 40 are associated with the receiving device 30 and are similar to that described previously for the warning devices 14. This can include the warning devices 40 outputting the indication that a train vehicle is approaching with respect to the track 16, 34, or both, based on the previously described communication with the train vehicle moving along the particular track(s).

In one embodiment of the system 10, the warning devices 14 and 40 can be part of a same group. For instance, the warning devices 40 can output the indication that the train vehicle 12 is approaching in the same manner as the warning devices 14, such as described previously. In this instance the warning devices 14, 40 can be synchronized (e.g., whether in relation to the train vehicle 12, a train vehicle movable along the track 34, or both). In another embodiment of the system 10, the warning devices 40 can be part of a group that is separate from the warning device 14, and therefore may be addressed and configured to output an indication that a train vehicle is approaching independent of the warning devices 14 (e.g., so that the indication output by the warning devices 40 is specific to a train vehicle on the track 34, and in some cases specific to parameters received from the train vehicle on the track 34). This can be done by associating the warning devices 40 with the receiving device 30 in some cases, and in other cases associating the warning devices 40 with a distinct receiving device.

Figure 2A:
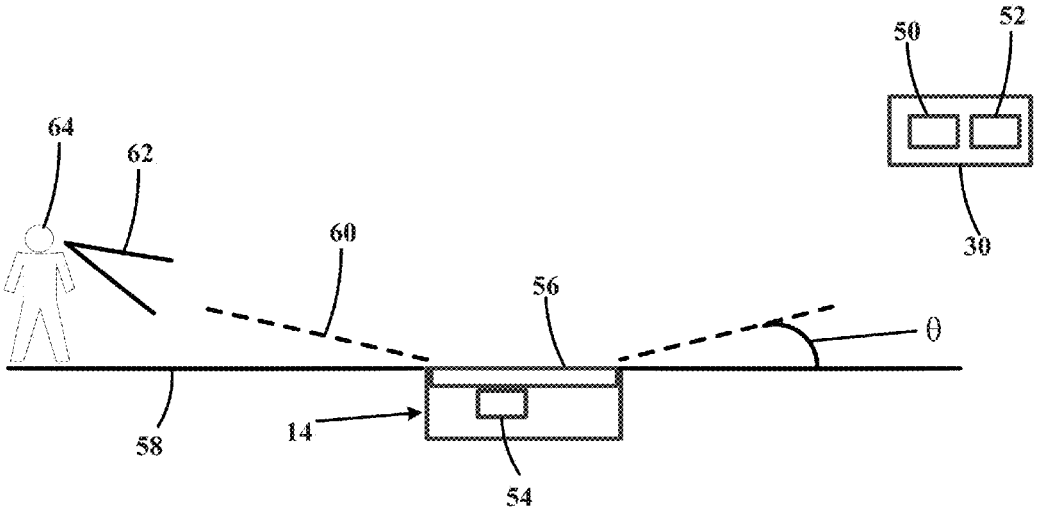
FIG. 2A is schematic side elevational view diagram illustrating an exemplary embodiment of a warning device.
Figure 2B:
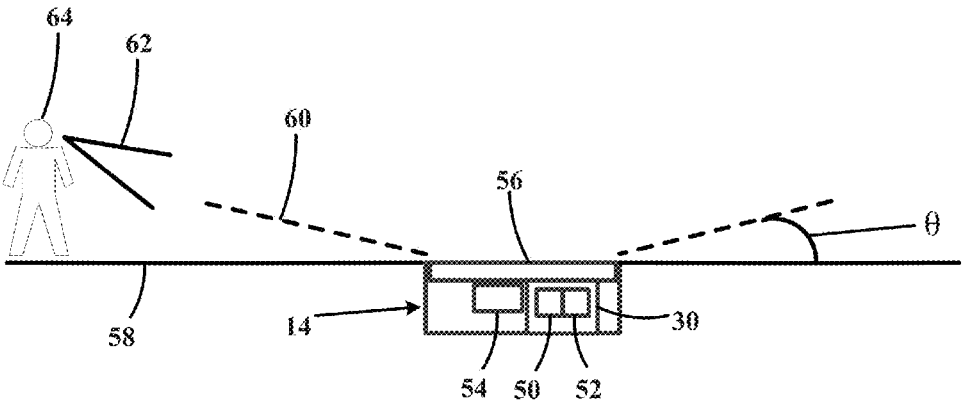
FIG. 2B is a schematic side elevational view diagram illustrating another exemplary embodiment of a warning device.

Further exemplary details of the warning devices 14 will now be described. In various embodiments, the details provided herein with respect to the warning devices 14 may also equally apply to the warning devices 40. FIGS. 2A and 2B show schematic, side elevational view diagrams of exemplary embodiments of the warning device 14 described in connection with FIG. 1.

Each of the embodiment of the warning device 14 shown in FIG. 2A and the embodiment of the warning device 14 shown in FIG. 2B is associated with the receiving device 30. While the embodiment of the warning device 14 shown in FIG. 2A includes the receiving device 30 as an external component in communication with the warning device 14, the embodiment of the warning device 14 shown in FIG. 2B includes the receiving device 30 as a component integrated within, and thus in communication with, the warning device 14.

In both illustrated embodiments, the receiving device 30 is shown to include communications circuitry 50 and processing circuitry 52. Communications circuitry 50 is configured to receive communications from one or more external sources (e.g., the train vehicle, central control station, warning devices positioned at a distant section of the track, remote mobile device, etc.), for instance as previously described. In some embodiments, communications circuitry 50 may also be configured to send communications to one or more external sources, for instance as previously described. Communications circuitry 50, in sending and/or receiving communications, may further be configured to encode or decode such communications as appropriate for the particular communication. Processing circuitry 52 may include a processor and local memory (e.g., non-volatile memory) configured to process received information, via the communications circuitry 50, according to stored instructions as described previously. For example, the processing circuitry 52 can determine based on the received information 1) when to output the indication, 2) the duration for which the indication is to be output, and/or 3) whether any adjustments to the indication are to be made. The processing circuitry 52 can then output a signal to the warning device 14 (e.g., to a controller 54 of the warning device 14) according to such determination.

Each embodiment of the warning device 14 shown in FIGS. 2A and 2B can include an emitter 56. The emitter 56 may be in communication with the controller 54 when present, and thus the emitter 56 may output an indication upon receiving an appropriate communication from the controller 54. The emitter 56 can include any one or more devices useful for outputting an indication that a train vehicle is approaching. In one example, the emitter 56 can include a visible light source, in another example the emitter 56 can include an audible sound source, and in a further example the emitter 56 can include both the visible light source and the audible sound source.

As described previously, the warning device 14 can be positioned at an elevation 58, where the elevation 58 is a common elevation for both the track and travel pathway. This can include the emitter 56 of the warning device 14 being positioned at the elevation 58, as seen in FIGS. 2A and 2B. As shown in FIGS. 2A and 2B, the warning device 14 can be positioned at the elevation 58 so as to be embedded at the elevation 58. Embedding the warning device 14 at the elevation 58 may include positioning the emitter 56 flush with the elevation 58, and thereby flush with the surface of the track and travel pathway. Such positioning of the warning device 14, and thus emitter 56, can allow for passage along the elevation 58 and over the warning device 14, and thus emitter 56, without obstruction.

In examples where the emitter 56 outputs visible light 60 as one type of the indication, the warning device 14, and thus the emitter 56, can be positioned and configured to output the visible light 60 at an angle θ that catches a downward viewing angle 62 of a pedestrian 64 (e.g., looking downward in a ground-level direction at a mobile device simultaneous to walking). The angle θ can be any angle from zero to one hundred and eighty degrees. In one embodiment, where the emitter 56 is positioned at the common elevation 58, the emitter 56 is configured to output the visible light 60 at the angle θ measured from the elevation 58 to a center of the output visible light 60. The angle θ, in one example, can be less than ninety degrees. In this example, the particular measurement of the angle θ being less than ninety degrees may vary across embodiments depending on a distance from the warning device 14 at which the visible light 60 is desired to catch the downward viewing angle 62 of the pedestrian 64. Thus, in some such embodiments the warning device 14, and thus the emitter 56, is configured to output visible light 60 from a side of the warning device 14 at an angle θ that is less than ninety degrees and is a function of a distance between the emitter 56 and an initial point at which a travel pathway and the track intersect at that side of the warning device 14. In the illustrated examples, the visible light 60 is output from the emitter 56 at two opposite sides of the warning device 14 (e.g., sides facing respective a travel pathway).

The described position and configuration of the warning device 14, and thus the emitter 56, can provide various beneficial uses. For example, it may provide a warning device 14 that is better equipped than traditional crossing guard lights to prevent collisions with the train vehicle in the case of distracted pedestrians looking downward, and who would not otherwise notice a traditionally positioned and configured crossing guard light.

As noted, in addition to the described positioning and configuration of the warning device 14, the receiving device 30, such as via communications circuitry 50, can be configured to both receive a communication from an external source and send a communication to the external source. In certain embodiments, the receiving device 30 can be configured to communicate with a mobile device, such as a mobile device carried by the pedestrian 64. In such example, the communications circuitry 50 can include any one or more components for communicating wirelessly with the mobile device (e.g., Bluetooth transmitter and receiver). In some cases, the mobile device may run an application locally thereat to facilitate communication between the mobile device and the communications circuitry 50. The application run at the mobile device may in some examples use real-time locational information of the mobile device.

Once the mobile device is within a predetermined range of the receiving device 30, the receiving device 30 can be configured to link with the mobile device. The link between the mobile device and the receiving device 30 can result in one or more alerts being activated at the mobile device of the pedestrian 64 once the mobile device is within a predetermined distance of the receiving device 30 and/or warning device 14. For example, the receiving device 30 may receive a communication from the mobile device (e.g., when the mobile device is running the local application) and use the communication to determine a present distance between the mobile device and the receiving device 30 and/or the warning device 14. In one embodiment, if the receiving device 30 determines that the mobile device is within the predetermined distance and the train vehicle is approaching based on the communication with the train vehicle as described previously, the receiving device 30 can be configured to output a signal to the mobile device to activate the alert. The one or more alerts activated at the mobile device as a result of the communication between the communications circuitry 50 and the mobile device can include, for instance, a vibration at the mobile device, an audible noise at the mobile device, and/or visual alert at a user interface (e.g., display screen) of the mobile device. In some examples, the alert at the mobile device can be activated and/or adjusted in synchronization with the indication output by the warning device 14 as previously described once the mobile device is within the predetermined range of the receiving device 30. The communication between the mobile device and the receiving device 30 can include instances where the receiving device 30 is part of warning device 14 or separate from but associated with warning device 14.

Therefore, the activation of the alert at the mobile device can further act to prevent collisions between the train vehicle and a pedestrian carrying a mobile device, especially in the case of pedestrian 64 with the downward viewing angle 62 (e.g., looking downward in a ground-level direction at the mobile device simultaneous to walking). As noted, the determination to activate the alert at the mobile device can be made by the receiving device 30 based on the location of the mobile device in conjunction with the described processing of information received from the train vehicle. Thus, the warning device 14 can be configured to output the indication that the train vehicle is approaching as well as activate the alert at the mobile device.

Figure 3:
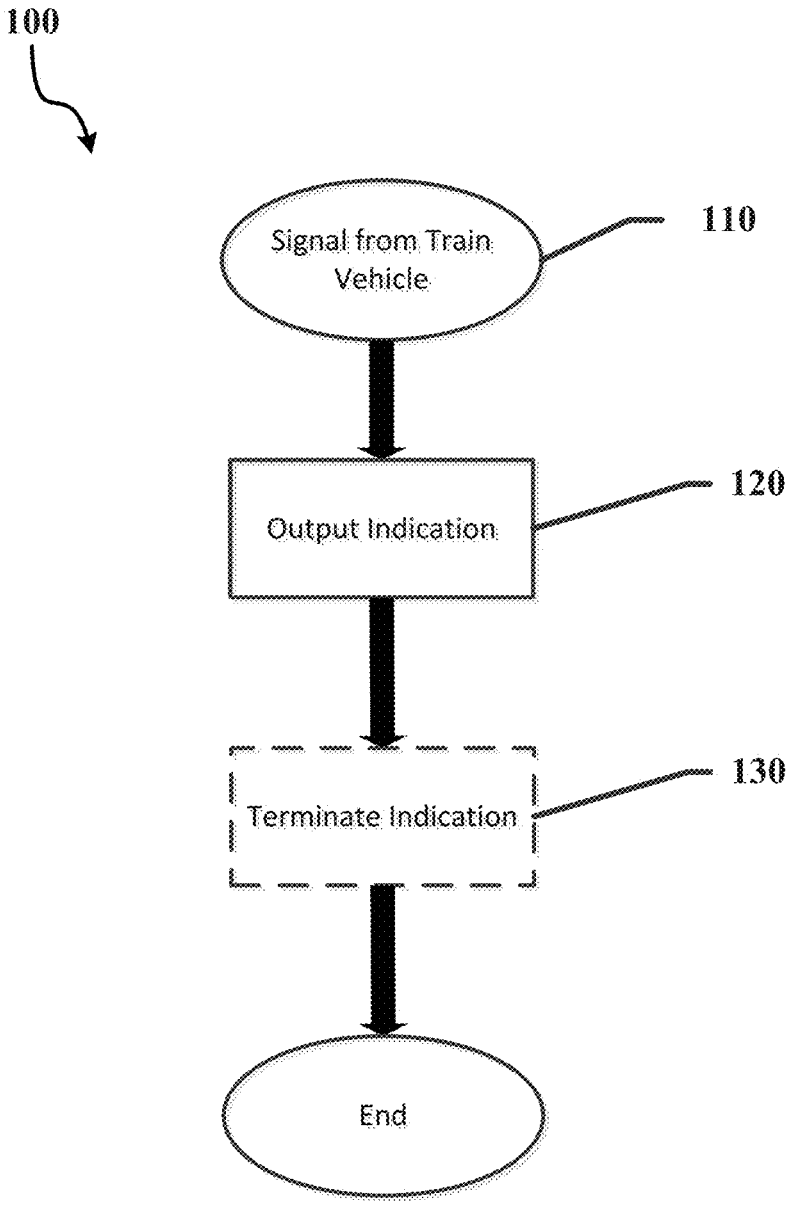
FIG. 3 is a flow diagram illustrating an exemplary embodiment of a method of train safety warning.

FIG. 3 shows a flow diagram illustrating an exemplary embodiment of a method (100) of train safety warning. In the illustrated embodiment, a signal is sent from the train vehicle to the receiving device associated with the warning device (110). In various embodiments, the signal can be sent directly from the train vehicle to the receiving device or from the train vehicle to the receiving device through one or more external sources (e.g., through a central control station). The signal can include information related to various parameters of the train vehicle, such as, for example, a present position of the train vehicle along the track and/or a present rate of motion of the train vehicle. The warning device associated with the receiving device receiving the communication can be positioned, in one embodiment, at a same elevation as the track (e.g., the emitter of the warning device is positioned at the same elevation as the track).

An indication is output from the emitter of the warning device (120). The indication can be in various forms (e.g., visible light, audible) and represent to a nearby pedestrian, driver, bike rider, etc. that the train vehicle is approaching.

The indication can be output at a time, output for a duration, and/or adjusted based on the signal received from the train vehicle. In one example, where the signal from the train vehicle includes information on the present position of the train vehicle along the track and the present rate of motion of the train vehicle, the indication can be output from the emitter of the warning device at a time that is a function of the present position of the train vehicle along the track and the present rate of motion of the train vehicle. This can allow the indication to be output from the emitter of the warning device for a period of time that is of a constant duration for a range of different positions along the track and rates of motion of the train vehicle, with this period of time measured from the time at which the indication is first output to a time at which the train vehicle encounters the emitter. In one further such example, the indication can be first output from the emitter of the warning device at a time that is a function of the present position of the train vehicle along the track and the present rate of motion of the train vehicle, and second subsequently adjusted at a later time that is a function of the present position of the train vehicle along the track and the present rate of motion of the train vehicle. Such adjustment can take place in some examples during the described constant duration of the indication.

After the indication has been output and/or adjusted, the indication can be terminated (130). The indication can be terminated, for instance, once the train vehicle has passed over the warning device or passed by a location at which the warning device is positioned. In determining when to terminate the indication, in some examples a communication from the train vehicle to the receiving device can include information used to make the determination that the train vehicle has passed over the warning device or passed by a location at which the warning device is positioned. Such information can include a present position of the train vehicle along the track sent to the receiving device associated with the warning device. Terminating the indication may include stopping the output of visible light and/or stopping the output of audible noise from the emitter of the warning device. In some examples, terminating the indication can include adjusting the indication so as to be a predetermined type of output that indicates a train vehicle is no longer approaching or within a predetermined distance uptrack from the warning device. As one such example, terminating the indication could include adjusting the visible light indication output from the emitter from one color to another different color (e.g., changing the visible light indication from red to white, etc.).

In this way, the indication may no longer be output when the train vehicle is no longer approaching the location of the warning device, and thus the risk of a collision with the train vehicle has substantially subsided. The warning device can then at a later time receive a signal from a train vehicle and use the information conveyed in the signal to output the indication from the emitter based thereon as previously described in the above examples.

Various examples have been described. These and other examples are within the scope of the following claims.

The invention claimed is:

1. A train safety warning system comprising:

a train vehicle including a transmitter, the train vehicle positioned on and movable along a track; and a first warning device including an emitter that is positioned at a same elevation as the track, the first warning device in association with a receiving device that is in in signal communication with the train vehicle, the emitter configured to output an indication that the train vehicle is approaching at a time that is a function of a position along the track and a rate of motion of the train vehicle based on the signal communication with the train vehicle.

2. The system of claim 1, wherein the first warning device is positioned adjacent the track.

3. The system of claim 1, wherein the track includes first and second opposing rails defining a space between the first and second opposing rails, and wherein the first warning device is positioned at the space between the first and second opposing rails.

4. The system of claim 1, wherein the indication output by the emitter is visible light of a first color.

5. The system of claim 4, wherein the indication output by the emitter further comprises an audible indication.

6. The system of claim 1, wherein the first warning device is positioned at a location along the track where the track intersects a travel pathway, the track and the travel pathway intersecting at a same elevation.

7. The system of claim 1, wherein the receiving device is in direct signal communication with the transmitter of the train vehicle.

8. The system of claim 1, wherein the receiving device is in signal communication with the train vehicle through a central control station.

9. The system of claim 1, wherein the signal communication between the train vehicle and the receiving device includes information related to a position along the track and a rate of motion of the train vehicle.

10. The system of claim 9, further comprising a second warning device including an emitter, the second warning device in association with the receiving device that is in in signal communication with the train vehicle, the emitter of the second warning device positioned at the same elevation as the track and configured to output the indication that the train vehicle is approaching based on the signal communication with the train vehicle.

11. The system of claim 1, wherein the emitter is configured to adjust the indication that the train vehicle is approaching as the position along the track of the train vehicle changes.

12. The system of claim 1, wherein the train vehicle further includes an input device in communication with the transmitter, and wherein user actuation of the input device causes the transmitter to send a control signal to the receiving device, the control signal causing the emitter to output the indication that the train vehicle is approaching.

13. The system of claim 1, wherein the indication output by the emitter is visible light, and wherein the emitter is configured to output the visible light at an angle less than ninety degrees as measured from the elevation of the track and in a direction of a travel pathway that intersects the track.

14. A warning device comprising:

a receiving device configured to be in signal communication with a train vehicle that is movable along a track; and an emitter configured to output an indication that the train vehicle is approaching based on the signal communication between the receiving device and the train vehicle, wherein the emitter is positioned at an elevation that is the same as that of the track and the indication output by the emitter is visible light of a first color, wherein the emitter is configured to output the visible light at an angle less than ninety degrees as measured from the elevation of the track and in a direction of a travel pathway that intersects the track.

15. The device of claim 14, wherein the emitter is positioned at a space defined between first and second opposing rails of the track.

16. The device of claim 15, wherein the emitter is configured to output the visible light from a first side of the warning device at the angle less than ninety degrees and in the direction of the travel pathway, and wherein the emitter is further configured to output the visible light from a second side of the warning device at the angle less than ninety degrees and in the direction of the travel pathway, the second side being opposite the first side.

17. The device of claim 14, wherein based on the signal communication between the receiving device and the train vehicle the first color is output by the emitter when the train vehicle is at a first location along the track, and wherein based on the signal communication between the receiving device and the train vehicle a second color is output by the emitter when the train vehicle is at a second location along the track, the first color differing from the second color, and the first location differing from the second location.

18. A train safety warning system comprising:

a warning device including an emitter and an associated receiving device that is configured to be in signal communication with a transmitter on a train vehicle, the emitter configured to output an indication that the train vehicle is approaching based on the signal communication with the train vehicle; and an application configured to be run at a mobile device that is separate from the train vehicle, wherein the application is configured to establish a wireless communication link between the warning device and the mobile device, and wherein the application is configured to activate an alert at the mobile device when both the mobile device is within a predetermined distance of the warning device and the indication is output by the emitter.

19. The system of claim 18, wherein the emitter is configured to output the indication that the train vehicle is approaching at a time that is a function of a position of the train vehicle and a rate of motion of the train vehicle.

20. The system of claim 19, wherein the emitter is configured to adjust the indication that the train vehicle is approaching as the position of the train vehicle relative to the warning device changes, and wherein the warning device is configured to activate the alert at the mobile device and adjust the alert at the mobile device in synchronization with the indication output at the emitter.

* * * * *